US006645016B1

(12) United States Patent
Andersen et al.

(10) Patent No.: US 6,645,016 B1
(45) Date of Patent: Nov. 11, 2003

(54) MERCHANT NAVY VESSEL COMPRISING A HULL THAT IS PROVIDED FOR ACCOMMODATING GOODS AND/OR PEOPLE

(75) Inventors: Peter Andersen, Hamburg (DE); Wolfgang Rzadki, Glinde (DE); Hannes Schulze Horn, Gladbeck (DE); Hans van Mameren, BX Rotterdam (NL)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/019,554

(22) PCT Filed: Jun. 19, 2000

(86) PCT No.: PCT/DE00/02016

§ 371 (c)(1),
(2), (4) Date: May 16, 2002

(87) PCT Pub. No.: WO01/00484

PCT Pub. Date: Jan. 4, 2001

(30) Foreign Application Priority Data

Jun. 24, 1999 (WO) ..... PCT/DE99/01842

(51) Int. Cl.[7] ..... B63B 3/00
(52) U.S. Cl. ..... 440/6; 114/65 R
(58) Field of Search ..... 440/6, 49, 54; 114/144 R, 144 B, 144 E, 65 R, 77 R

(56) References Cited

U.S. PATENT DOCUMENTS

| | | | | |
|---|---|---|---|---|
| 4,476,798 A | | 10/1984 | Backus | 114/77 R |
| 4,678,439 A | | 7/1987 | Schlichthorst | 440/11 |
| 5,259,332 A | | 11/1993 | Sekiguchi et al. | 114/65 R |
| 5,417,597 A | | 5/1995 | Levedahl | 440/6 |
| 6,375,524 B1 | * | 4/2002 | Commandeur et al. | 440/54 |
| 6,431,928 B1 | * | 8/2002 | Aarnivuo | 440/58 |

FOREIGN PATENT DOCUMENTS

| | | |
|---|---|---|
| DE | 6937931 | 4/1970 |
| DE | 2929203 A1 | 6/1981 |
| DE | 3424067 C2 | 1/1986 |
| DE | 3426333 C2 | 1/1986 |
| DE | 4100467 A1 | 7/1992 |

OTHER PUBLICATIONS

"Ein neueschocheffizientes Antriebssystem", *Schiff Und Hafen*, pp. 40–44, 10/97.
"The Command, Control Communications and Information System", SF 300 Booklet.
"Siemens–Schottel–Propulsor (SSP). The podded electric drive with permanently excited motor", AES 97—All Electric Ship Conference, pp. 1–24, 3/97.

* cited by examiner

*Primary Examiner*—S. Joseph Morano
*Assistant Examiner*—Lars Olson
(74) *Attorney, Agent, or Firm*—Harness, Dickey & Pierce, P.L.C.

(57) ABSTRACT

A ship includes a ship's hull which is intended for accommodating cargo and/or people, and at least one rotatable steering propeller as a propulsion unit. The rotatable steering propeller is arranged in a connection unit in the form of a box in the stem of the ship's hull. Electrical and mechanical components for supplying power to and controlling the steering propeller and its electric motor are at least partially combined in functional modules which are in the form of a transport container. The container is designed such that it can be functionally tested, can be accepted at its point of manufacture, and can be installed in this form at any desired location in the ship based upon the container base structure.

31 Claims, 5 Drawing Sheets

MERCHANT NAVY VESSEL COMPRISING A HULL THAT IS PROVIDED FOR ACCOMMODATING GOODS AND/OR PEOPLE

This application is the national phase under 35 U.S.C. §371 of PCT International Application No. PCT/DE00/02016 which has an International filing date of Jun. 19, 2000, which designated the United States of America, the entire contents of which are hereby incorporated by reference.

1. Field of the Invention

The invention generally relates to a Merchant Navy ship having a ship's hull which is intended for accommodating cargo and/or people. Preferably, it includes at least one rotatable steering propeller. The propeller is preferably in the form of a propulsion unit. The rotatable steering propeller is preferably arranged in a connection unit in the form of a box in the stern of the ship's hull. The components required for controlling the steering propeller are preferably located in the ship's hull.

2. Background of the Invention

A ship is known from German Utility Model G 69 37 931.3. This document discloses a steering propeller propulsion unit, which is arranged in what is referred to as a foundation box, and for which electrical and mechanical components must be provided in the ship's hull. Furthermore, a replaceable motor-transmission module for ship propulsion systems with propeller shafts which refers to the abovementioned document is disclosed in DE 34 26 333 C2. The known motor-transmission module can be inserted in the ship's hull from above, and can be connected to the ship's hull.

SUMMARY OF THE INVENTION

An object of the invention, going beyond the already known solutions which operate with propulsion functional modules, is to specify a ship with steering propeller. This provides a particularly cost-effective design for the entire ship's propulsion system and, possibly, also for the ship's steering control system.

In the past, for Merchant Navy ships, it was normal to send the electrical and electromechanical components individually to the installation location, that is to say to the dockyard. The electrical and electromechanical components include, for example: generators, motors, transformers, switchgear systems, converter systems, cooling systems, distribution systems, control stations etc. These components are manufactured by different manufacturers, supervised by the Classification Authorities. They are then dispatched in packaging by land or by sea, depending on the destination. The individual deliveries are received in logistic form by the dockyard. The dockyard personnel transport the electrical and electromechanical components to the ship, where they are fitted and attached to the appropriately prepared foundations. The individual components are then wired up to one another and connected by specialist personnel. The wiring for the components is checked, and the system commissioned, by the system supplier. The operation of the systems is checked during the stationary test run and during the dockyard trials, and is accepted by the Classification Authority and the end user. This known procedure is highly costly particularly, for example, if the dockyard is located in the Far East and the components are manufactured in Europe. This is evermore frequently the situation for special ships, in particular for special diesel-electric ships. This results in very high personnel costs, especially for the system supplier, due to the relatively long time for which the personnel are away from base.

One object of the invention is to specify a modular system. Such a system preferably considerably reduces the personnel costs as well as the transport costs for special ships with rotatable steering propellers, which make up an ever greater proportion of the world market. In this case, in particular, one aim is to improve the functional reliability of the components that are supplied, to avoid incorrect connections of the components by the personnel who are used in the emerging markets and, in particular, have no experience of the construction of modern diesel-electric ships.

This object is achieved, for example, by a steering propeller including an electric propeller motor. Preferably, the electrical and electromechanical components for supplying power to and controlling the steering propeller and its motor are at least partially combined in functional modules which are in the form of a transport container. Preferably, the container is a standard container, designed such that it can be completely functionally tested, can be accepted by the Classification Authorities at its point of manufacture, and/or can be installed in this form at any desired location in the ship by means of the container base structure.

The abovementioned technical solution advantageously results in a considerable reduction in the construction costs of a ship—which cost reductions have been calculated to be more than 10%. Furthermore, the functional reliability of the ship propulsion system is improved, since the individual propulsion components are installed and connected to one another using specialist personnel. Repairs are also simplified, since the components that are supplied are installed in the ship in accordance with the specification and in a manner which is documented at the point of manufacture. Discrepancies between the design standard and the actual standard no longer occur, so that this results in considerably improved repair reliability, and an improved capability for remote diagnosis. In this case, the individual containers can advantageously each have a remote diagnosis unit. The remote diagnosis unit, or some similar unit, can advantageously also be used for continuous monitoring of the functional components in the container or in the steering propeller. The Inmarsat system can be used for this purpose, as is also already used for monitoring entire ships by the shipping line centers.

A refinement of the invention provides for the transport containers to have entirely or partially removable side parts and/or top parts. This advantageously makes it possible to provide accessibility to the ship's propulsion system and to the individual components in a manner corresponding to the known open methods of construction.

A further refinement of the invention provides that the functional modules can be placed on foundations in the ship, and are designed such that they can be permanently connected to the ship. The functional modules can be permanently connected to the ship by welding or screwing. It is thus possible to connect the functional modules to the ship in a particularly cost-effective manner. Solutions such as those disclosed in DE 34 24 067 C2 are also known to the German Navy, in which the individual guns or the like are each provided with standard containers, which have the necessary electrical systems for operating the guns, for example, in order to improve the protection when being fired at. However, these containers normally have sprung suspension using suspension elements and are also designed differently in other respects. They cannot provide any information relating to the embodiment according to the invention, or its purpose.

A further refinement of the invention provides for the functional modules to have hydraulic input and output lines as well as cooling water input and output lines which are ready to be connected, and, in a particular manner, power cables, control cables and signal cables. This design ensures that the individual functional containers can all satisfy the requirements placed on them. Even though they are still transported, the components mounted in them satisfy all the requirements which are placed on them following final installation of the containers. This applies in particular to the cooling and to the production of movements based on hydraulic systems, for example for the rotational movement of the electrical steering propeller. The functional containers are thus designed to be completely functional not only electrically, but also mechanically and hydraulically.'

Another refinement of the invention advantageously provides for the ship propulsion system to have at least three functional modules, which comprise the following three system components: power generator system, power distribution system and ship's propeller drive. The ship's propeller drive, which, like all the other functional modules, is delivered to the dockyard in an already completely installed state, only exceptionally fits into one container, for example into a standard container. Since the electrical propeller drive has a stable outer wall, however, and, apart from this, is designed to be completely encapsulated from the water surrounding it, such packaging can be dispensed with without adversely affecting the idea of prior installation. Thus, overall, this results in a modular system which comprises completely prefabricated functional units and requires no further packaging for dispatch.

The individual modules can in this case advantageously be provided with GPS receivers and position transmitters. It is thus possible to track the movement of the modules accurately while they are being dispatched. Corresponding techniques are known for hazardous goods containers or containers with perishable loads. The GPS receivers are advantageously arranged, in the same way as the position transmitters, with their power supply inside the containers, in order to prevent theft. The antenna system is located on the outside of the containers. The transmitter, receiver and antennas etc. are advantageously removable, and are sent back for reuse once the destination has been reached. Overall, the use of functional containers which are continuously monitored during dispatch results in considerably greater dispatch reliability than conventional dispatch. This relates to the disappearance of components, irrespective of whether this is in the dockyard or while on route.

For installation in the ship, the invention advantageously provides for the functional modules to be arranged in the stern, and to be located as close as possible to the steering propeller in this case. This advantageously results in short electrical and hydraulic cables and lines, and the particular advantage of the rotatable electrical steering propeller; that the interior of the ship can be optimized, is retained in a particular manner. It is advantageous if the individual functional containers are arranged approximately at the same level and for this level, for example, to be approximately the same level as that at which the steering propeller units are installed.

A further refinement of the invention provides for the ship according to the invention to have at least one diesel generator set in a container, which can preferably be arranged in the forward part of the ship or else in side tanks. This makes it possible to arrange the diesel generator system in the ship in a particularly advantageous manner with regard to the ship's trim. The complete encapsulation of the diesel generator set from the outside of the container is particularly advantageous in this case.

For safety reasons, electrical steering propellers are designed with a double winding system, or each ship is designed to have two steering propellers, from the start. In both cases, it is particularly advantageous to also provide two functional containers for accommodating the required electrical, hydraulic and other components.

In the case of a ship as described above, which is equipped with two steering propellers, it is expedient for each steering propeller each to have its own associated container, in which functional modules, associated with that steering propeller, of the ship's propulsion system are arranged. When any servicing, maintenance or repair measures need to be carried out on one of the two containers, the other container, and hence the ship's propeller associated with this other container, are not adversely affected, in any situation. In order to simplify the transportability and handling of the containers which contain the functional modules of the ship's propulsion system, it is advantageous for these containers to be 40' or 12 m standard containers.

The container which contains the functional modules associated with the port-side steering propeller is expediently arranged on the port side, and the container which contains the functional modules associated with the starboard-side steering propeller is expediently arranged on the starboard side of the ship's longitudinal axis.

For weight distribution within the ship, it may be advantageous for the two containers which contain the functional modules associated with the two steering propellers to be arranged symmetrically with respect to one another with reference to the ship's longitudinal axis, since their weights then balance one another out. The starboard-side container and the port-side container advantageously contain the same functional modules. According to one advantageous refinement, the functional modules which are contained in the starboard-side container are arranged, with reference to the ship's longitudinal axis, symmetrically with respect to the functional modules which are contained in the port-side container and whose functions and types correspond to them.

One particularly advantageous arrangement of the containers in the stern area of the ship can be achieved if the arrangement of the functional modules in the starboard-side container is chosen to be in mirror-image form, with reference to the longitudinal center axis thereof, with respect to the arrangement of the functional modules in the port-side container, with reference to the longitudinal center axis thereof.

According to a further advantageous embodiment of the ship according to the invention, an easily accessible inspection catwalk is provided on the outside of each of the longitudinal walls, facing the ship's longitudinal axis, of each of the containers which are associated with the two steering propellers. This considerably simplifies access to the functional modules for installation, maintenance, servicing and repair work. Furthermore, it is possible to connect the two inspection catwalks, which are provided on those longitudinal walls which face the ship's longitudinal axis of the two containers associated with the steering propellers, to one another by means of a transverse catwalk, thus further simplifying the maintenance of the functional modules of the ship's propulsion system contained in the two containers. This is particularly advantageous when identical maintenance or servicing work must be carried out on identical functional modules.

If the transverse catwalk which connects the two inspection catwalks is arranged close to those end walls of the two containers which face the steering propellers, this transverse catwalk can also be used for monitoring and/or maintenance and repair of installations which are connected downstream from the two containers, relating to the propulsion system and the steering propellers.

The access to the individual functional modules arranged within the containers is further simplified if each of the two containers which are associated with the steering propellers has a door in its longitudinal wall facing the ship's longitudinal axis, through which door access can be gained to an inspection catwalk provided in the container.

A transformer system, a converter system, a control and regulation unit, a power supply section and a converter cooling system can expediently be arranged in each of the two containers associated with the steering propellers.

It has been found to be an advantageous refinement for the transformer system in each of the two containers to have one to three converter transformers, depending on the circuitry.

For safety reasons, it may be advantageous for the transformer system in each container to be arranged in a separate chamber, which is separated by means of a transverse wall, or in a separate container alongside.

In this case, the chamber accommodating the transformer system should be arranged between the transverse wall and that end wall of the container which is remote from the steering propeller, since this then makes it possible to minimize the distance between the power supply section and the electrical motor for the steering propeller.

The cable entries for the transformer systems in the containers associated with the steering propellers can be formed at the top in the top wall, at the bottom in the base wall, or in those end walls of the containers which are remote from the steering propellers, in which case it has been found to be particularly expedient for the cable entries to be arranged in the region of the lower corner, remote from the ship's longitudinal axis, of that end wall of each container which is remote from the steering propeller.

For reliability of operation of the converter transformers, it is advantageous or, for certain requirement profiles, essential for the converter transformers in the transformer system in each container associated with the steering propellers to be cooled by means of a ventilation system.

A flow monitor and a temperature monitor are advantageously arranged in the cooling air flow of the ventilation system, in order to monitor the cooling effect of the ventilation system.

A part of the air flow from the ventilation system associated with the converter transformers is advantageously used to ventilate the rest of the container.

In order to prevent impure air from the environment entering the container, it is advantageous for the ventilation system to have an air circuit, in which case the desired low temperature of the air flow carried in the air circuit can expediently be ensured by means of an air cooler which is arranged in the air circuit.

Such an air cooler may, for example, be arranged underneath the base wall of the container or else in the interior of the container, namely on the inside of that end wall of the container which is remote from the steering propeller.

Even if the cooling of the converter transformers is subject to particularly stringent requirements, this can be ensured if each winding of each converter transformer in the transformer system has an associated cooling air supply opening, which advantageously directs cooling air from underneath onto that winding of the converter transformer that is associated with it. Air guide plates, which guide the cooling air flow onto the salient-pole cores of the windings are advantageously arranged on the converter transformers.

Alternatively, the cooling of the converter transformers in the transformer system can also be ensured by means of a water cooling system. This makes it possible to reduce the physical size of the converter transformers, provided the water cooling system can provide cooling with relatively cold water. Such a water cooling system and its water cooler can advantageously be arranged on that end wall of the container which is remote from the steering propeller.

For installation, maintenance, servicing and repair reasons, it is advantageous for each converter transformer in the transformer system to have an associated hatch, which is formed in that longitudinal wall of the container which faces the ship's longitudinal axis. The converter transformers are then accessible from the inspection catwalk on the outside of the longitudinal wall of the container.

An optimum arrangement of the functional modules within the container is achieved if the converter system, the control and regulation unit, an intermediate area for the inspection catwalk on the container side, and the converter cooling system are arranged successively in each of the two containers associated with the steering propellers, on the inside of that longitudinal wall of the container which faces the ship's longitudinal axis, starting from the transverse wall in the direction of that end wall of the container which is on the steering propeller side.

The power supply section of the container is advantageously arranged between that longitudinal wall of the container which is remote from the ship's longitudinal axis and the outer wall of the converter cooling system opposite it.

The connecting cables between the power supply section, which is arranged in the container, and the electric motor of the steering propeller associated with that container can then advantageously pass through a cable opening which is formed in the end wall on the steering propeller side of the container.

This cable opening can expediently be arranged in the region of the upper corner, which is remote from the ship's longitudinal axis, of the steering-propeller-side end wall of each container.

The converter system in each container associated with the steering propeller is advantageously in the form of a direct converter, in which the number of electrical active-device modules depends on the circuit.

The cooling for the converter system can be designed in a particularly advantageous manner if the converter cooling system for each of the two containers associated with the steering propellers is in the form of a water cooling system.

For installation, maintenance, servicing and repair reasons, it is advantageous for the direct converter in the converter system to have an associated service opening, which is formed in that longitudinal wall of the container which faces the ship's longitudinal axis. The direct converter in the converter system is then easily accessible from the inspection catwalk provided on that longitudinal wall of the container which faces the ship's longitudinal axis, or on the outside of this wall.

A low-voltage switchgear assembly and an associated rotating converter for the propulsion system are advantageously arranged in a further or third container, which contains the functional modules of the ship's propulsion system.

In a corresponding way, according to a further advantageous embodiment, a medium-voltage switchgear assembly and an associated rotating converter for the propulsion system can be arranged in a further or fourth container, which contains the functional modules of the ship's propulsion system.

The converter system in each of the two containers associated with a respective steering propeller can advantageously preferably be in the form of a 12-pulse direct converter power section.

Its input voltage is expediently approximately 900 V, 3-phase.

In order to allow the direct converter power section to be accommodated in a standard container, it is expedient for there to be no connection panels on the power supply system side and for a busbar system, on the power supply system side, for thyristor modules in the direct converter power section to be designed such that power cables for the converter transformers can be connected directly.

The required current transformers and overvoltage protection devices can then expediently be arranged in the region behind the thyristor modules.

The insulation voltage of the power cable between the converter transformers at one end and the converter system at the other end is advantageously approximately 4 kV, or 3×1.633kV.

A cable rack is expediently provided for correct positioning and arrangement of the power cables between the converter transformers at one end and the converter system at the other end.

The cable rack is advantageously arranged in the upper region of the container, with the power cables being passed upward from the converter transformers to the cable rack, and the power cables to the thyristor modules in the converter system being supplied from above. Alternatively, the cable rack can also be arranged in the lower region or in a side region of the container.

It is possible to arrange the cable rack removably in the upper region of the container. Alternatively, the cable rack can be arranged in the upper region of the container such that the functional modules to be accommodated in the container can be installed without any interference.

In order to make the unobstructed height within a standard container as great as possible, it is advantageous if the two containers associated with the two steering propellers are designed without any false cable floor.

In order to mount the functional modules securely within the two containers associated with the two steering propellers, it is advantageous for these containers each to have transverse supports, which are designed as foundation supports for the converter system, for the control and regulation unit, for the power supply section and for the converter cooling system. In this case, one transverse support can hold both the power supply section and the converter cooling system.

Iron foundation bars are advantageous for mounting the converter transformers securely and in a fixed manner with these iron foundation bars in each case being extended such that they can be welded directly to the base frame or outer frame of the container.

In order to simplify transportability and the capability to handle the containers which accommodate the functional modules of the ship's propulsion system, its or their base frame should be designed and equipped with suspension means such that the container can be transported without any problems by means of a container crane.

In order to simplify the installation of those functional modules which form the components of the ship's propulsion system within the container, it is advantageous for the longitudinal walls, the end walls and the top wall of each container which accommodates the functional modules of the ship's propulsion system to be designed as a unit, which can be lifted off the base wall of the container like a cover at the start of the installation work, and can be fitted back onto it again at the end of the installation work.

In order to ensure that the containers which accommodate the functional modules of the ship's propulsion system do not bend over their entire length, pick-up points or supports, which follow one another in the longitudinal direction of the containers, should be formed or provided at those points on the ship at which such containers are intended to be arranged, in which case the distance between adjacent pick-up points or supports should expediently be a maximum of 3 m.

BRIEF DESCRIPTION OF THE DRAWINGS

Preferred embodiments of the invention will be explained in more detail using, by way of example, the drawings which, like the dependent claims, also reveal further details of the invention, and in which, in detail:

DETAILED DESCRIPTION OF THE PREFERRED EMBODIMENTS

Figure 1:
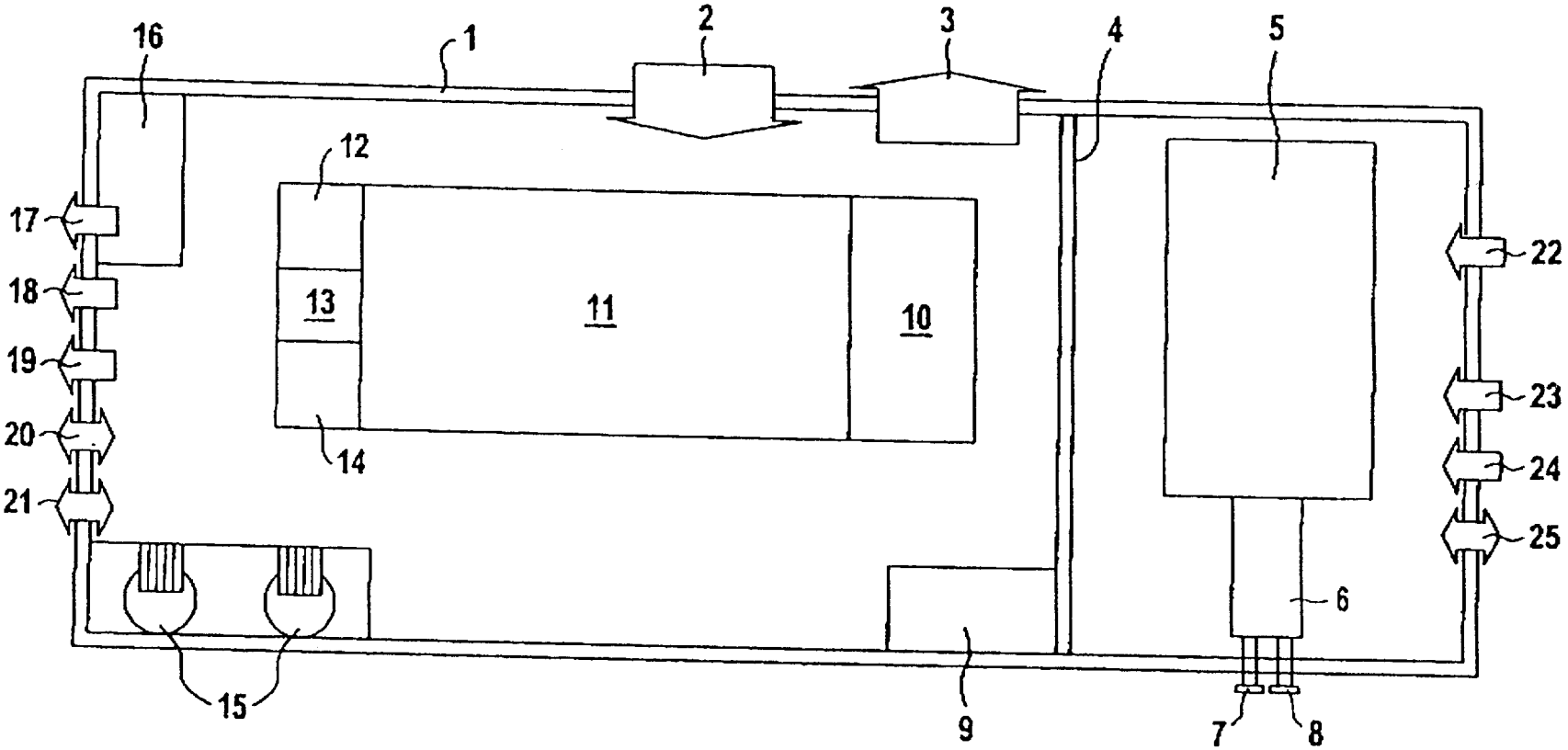
FIG. 1 shows an outline illustration, in the form of a section, of a functional container for the ship propulsion system.

In FIG. 1, 1 denotes a container for accommodating the components of the ship propulsion system, in particular a functional container for a rotatable electrical steering propeller. An air inlet line 2 leads into the container 1, and an air outlet line 3 leads out of it. Advantageously separated from the other components of the ship propulsion system by way of an intermediate wall 4, there is a converter transformer 5 on one side of the container, with a fresh water cooler 6 which is supplied via the fresh water inlet supply line 7 with fresh water, which leaves the cooler and the functional container through the outlet water line 8.

As a component, the functional container 1 contains the power converter 11, in particular a direct converter which, in the same way as the converter transformer, has a fresh water cooling system 10. The system 10 is supplied with cooling water through lines which are not shown in any more detail. The control and regulation system 12 for the power converter, a control and regulation system 13, for example for the other components in the container, and a control and regulation system 14 for example for ship-specific components, are arranged in the vicinity of the power converter, possibly connected directly to it. The hydraulic pumps 15 for the rotary movement of the electrical steering propeller are not specifically arranged close to the base of the functional container. Furthermore, the functional container also has a power supply section 9.

By way of example, power cables 22 from the medium-voltage switchgear assembly for the ship, cables 23 for transmitting the auxiliary power from the low-voltage switchgear assembly for the ship, and cables 24 from the emergency switch panel for the low-voltage supply for the ship and, with the two-way function, signal cables 25, preferably with a bus line, lead into the functional container. From the functional module 16 of the steering propeller, auxiliary power supply cables 18 and 19 as well as signal cables with a two-way function, in particular with a bus line, connect to the respective components in the ship which must be supplied with power. Furthermore, the functional module 1 has, for example, a hydraulic input and output line 21 for the rotational (azimuth) movement of the steering propeller.

The above description of the individual components in the functional module 1 is not exclusive and, in addition to the described components, it also includes further components of minor importance.

The illustrated inlet and outlet lines form interfaces to the ship system. The outlet air and inlet air are supplied to and taken from the air-conditioning system for the ship, and the fresh water is likewise taken from the ship's fresh cooling water system. Corresponding situations apply to the other inlet and outlet lines, which are all connected to the corresponding system components in the ship. Overall, this results in a functional module which just needs to be connected to the corresponding ship system parts by a screw connection or plug connection. It is intrinsically fully functional. Appropriate supply lines are provided for testing purposes at the installation location, and these are generally available in a production facility (factory, dockyard).

Figure 2:
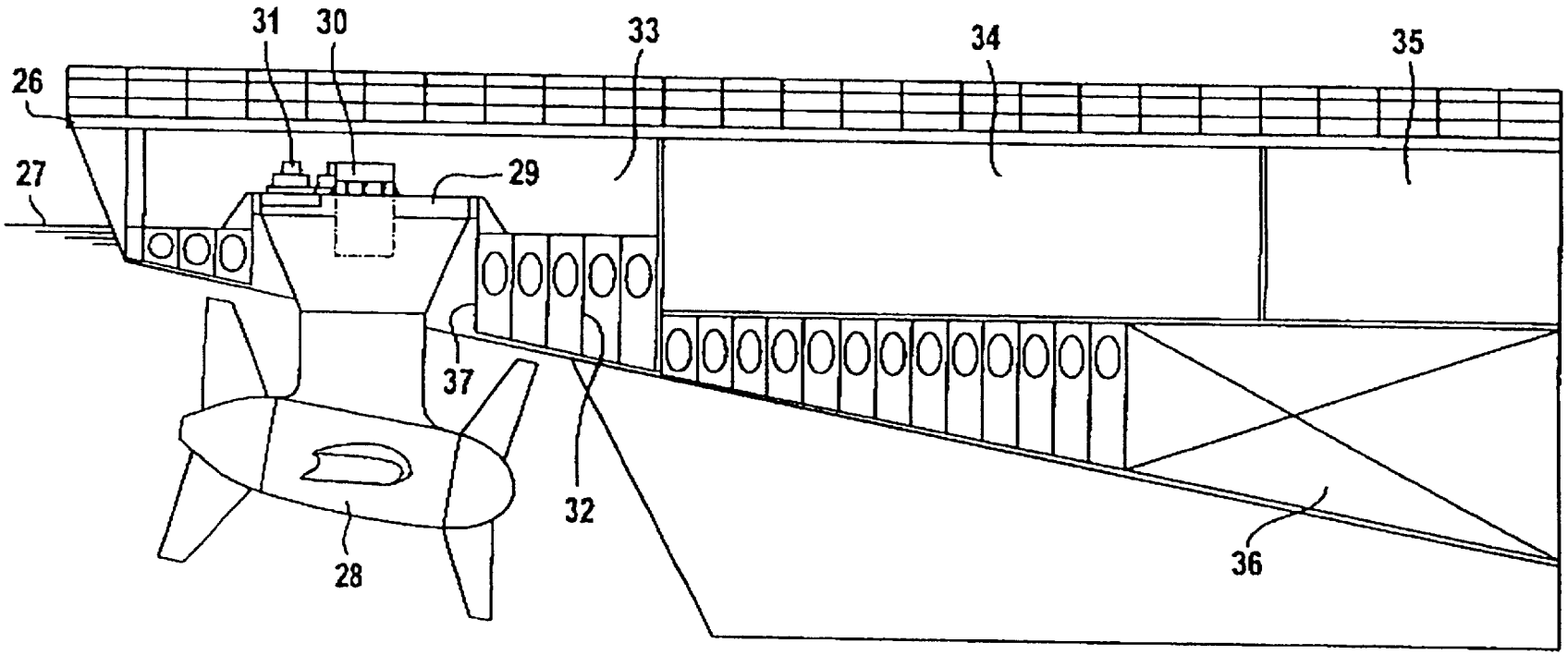
FIG. 2 shows an outline illustration, in the form of a section, of the stern of a ship with two rotatable electric steering propellers mounted under the stern.

The sectional side view of a ship as illustrated in FIG. 2 shows the ship's hull 26 with a rotatable steering propeller 28. The ship itself has a two-screw configuration. In the same way as the two-screw configuration, it is, of course, also possible to choose a single-screw configuration, or, optionally, even a configuration with a pulling or pushing propeller, or with a double propeller for the ship. The ship's waterline is annotated 27 and, as can be seen, the junction between the rotatable steering propeller 28 and the ship 26 is advantageously above the waterline. The rotatable steering propeller 28 is mounted on a foundation plate 29 on the upper face of a cutout, in the form of a box, in the ship's hull. A slipring transmission element 30 is indicated schematically in an aperture in the foundation plate 29, via which the propulsion power is transmitted for the electric motor in the steering propeller 28. The rotational (azimuth) movement of the steering propeller 28 is provided by means of hydraulic motors 31, which are likewise indicated in schematic form. Above the foundation plate 29 there is a free space 33 in which, if required, further less important components of the propulsion system can also be arranged. The foundation plate 29 is connected directly, for example by welding, to the frames 32, so that it is very simple to install the steering propeller 28 in the box-shaped cutout 37. A functional container 34 according to the invention is located at the same level as the rotatable steering propeller 28, directly alongside it, in the stern of the ship, so that this results in short lines. 35 denotes an empty space which can be used, for example, for access to the container 34, and 36 denotes, for example, a ballast tank, in order to make it possible, for example, to produce the optimum trimming state for the ship.

Figure 3:
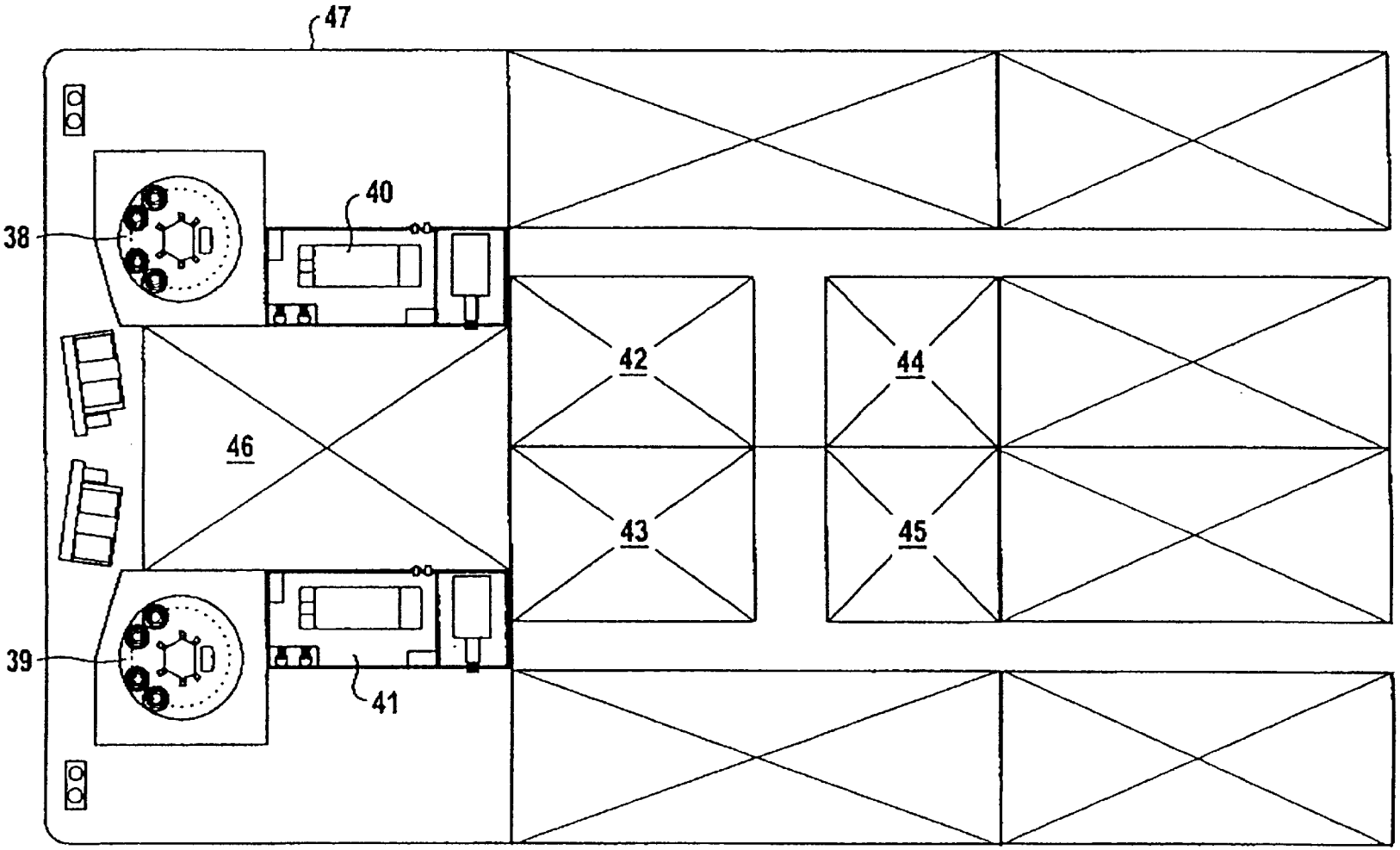
FIG. 3 shows an outline illustration, in the form of a section, of a stern of a ship as shown in FIG. 2.

In FIG. 3, 42, 43, 44, 45, 46, by way of example, and the further areas annotated by diagonal lines likewise indicate ballast tanks in the ship's hull 47. Cargo areas may, however, likewise be arranged here, for example in car ferries or the like.

In the illustrated example, two rotatable steering propellers 38, 39 are arranged at the stem of the ship and each is associated with a container 40, 41 as functional modules for the propulsion system, which contain the control and regulation system for the rotatable steering propeller. As can be seen, the use of an electrical steering propeller in conjunction with functional modules in the form of containers in the ship does not result in the loss of any valuable stowage space. The cargo area volume is thus optimized in a way that was impossible in the past, in particular in conjunction with diesel generator units which are arranged in the forward part of the ship and, possibly, in ballast tanks.

Figure 4:
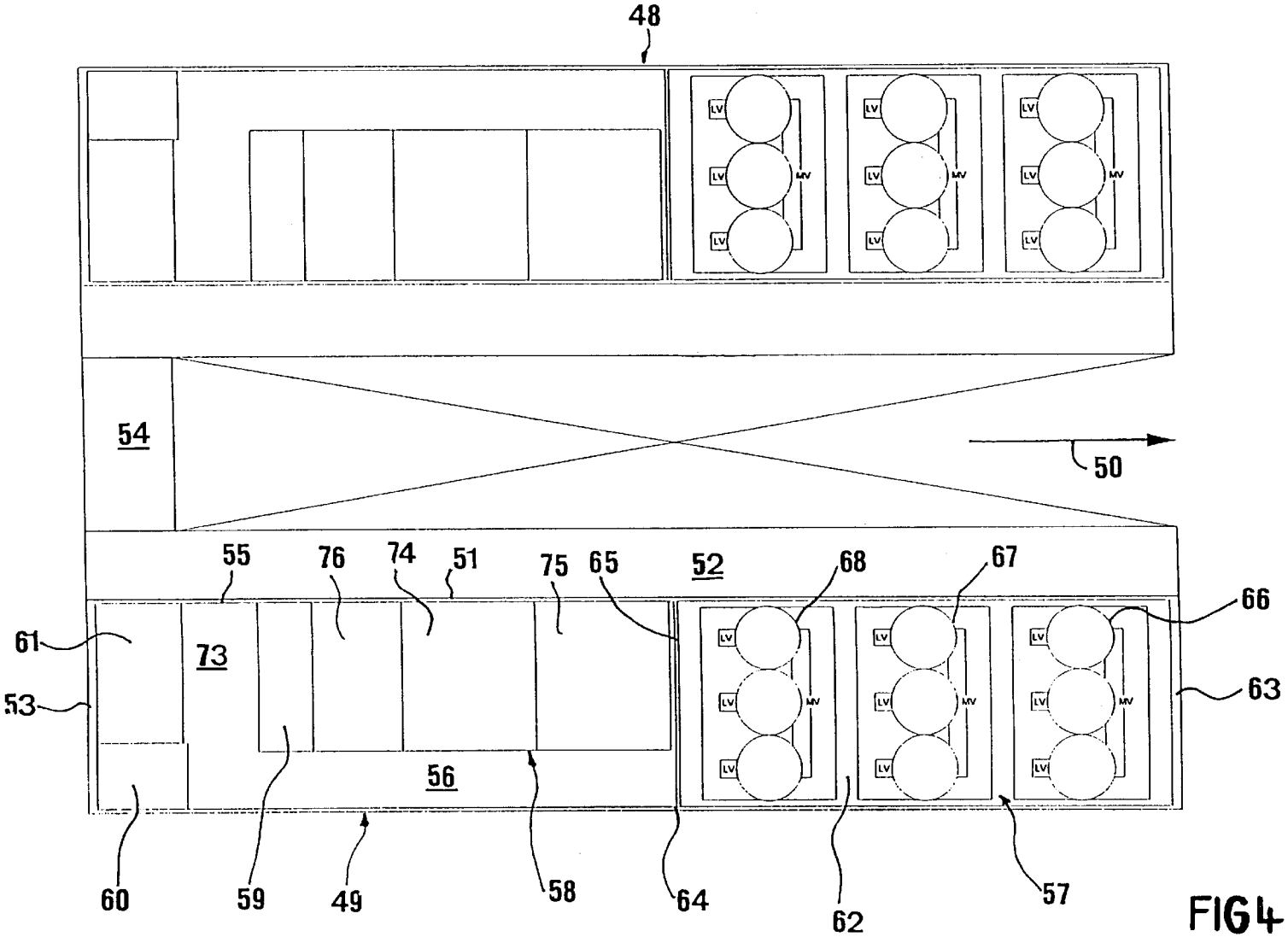
FIG. 4 shows an outline illustration of the arrangement of containers which contain the functional modules of a propulsion system for the ship.
Figure 5:
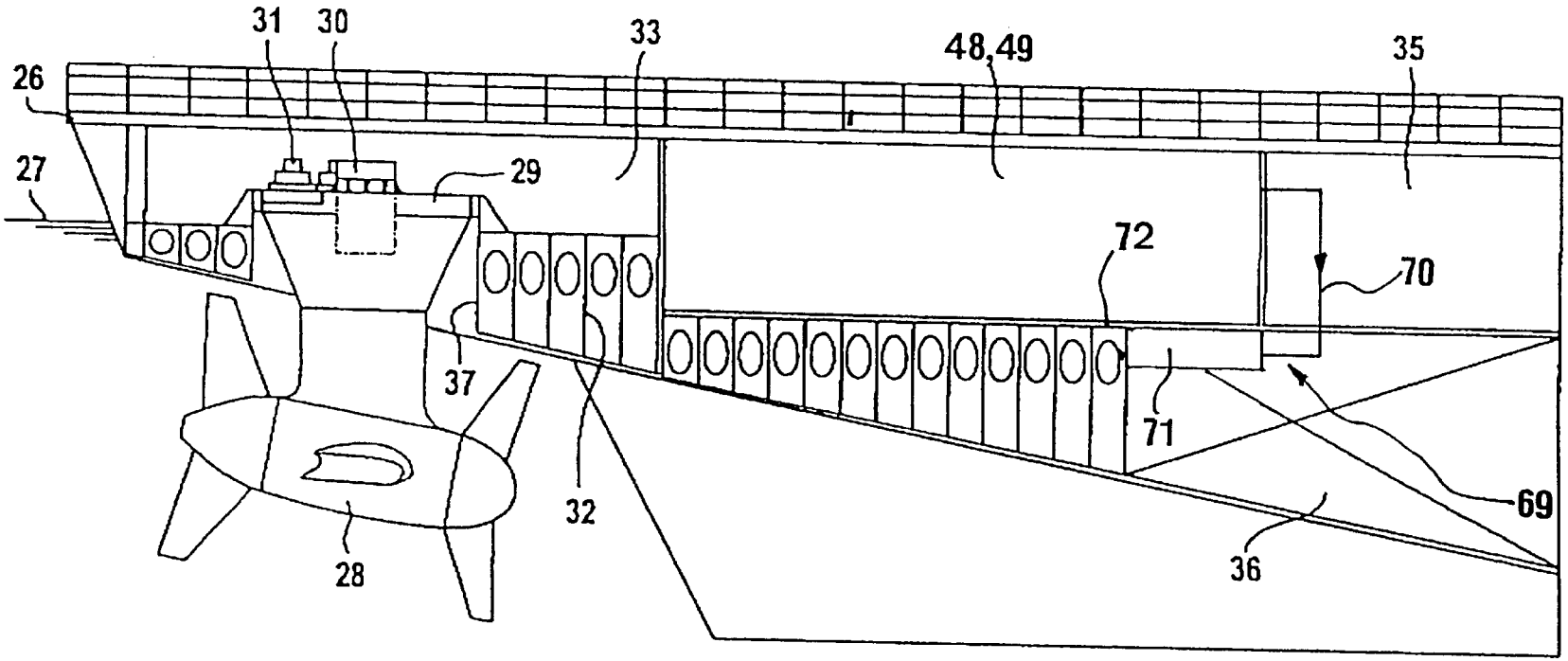
FIG. 5 shows an outline illustration, in the form of a section and corresponding to FIG. 3, of another embodiment of a container containing functional modules.

FIG. 4 shows two containers or functional containers 48, 49, which each have an associated steering propeller 28, illustrated in FIGS. 2 and 5. In this case, the upper container 48 in FIG. 4 is associated with the port-side steering propeller 28 while, on the other hand, the lower container 49 in FIG. 4 is associated with the starboard-side steering propeller 28. The direction of motion of the ship is indicated by the direction of motion arrow 50 in FIG. 4.

The functional modules of the ship's propulsion system which are associated with the port-side steering propeller 28 are arranged in the upper container 48 in FIG. 4. In a corresponding way, those functional modules of the ship's. propulsion system which are associated with the starboard-side steering propeller 28 are arranged in the lower container 49 in FIG. 4.

The two containers 48, 49 are both 40'(12 m) standard containers.

The ship's longitudinal axis runs approximately in the same direction as the direction of motion arrow 50 in the embodiment illustrated in FIG. 4. As can be seen from FIG. 4, the two containers 48, 49 are arranged symmetrically with respect to one another on both sides of the ship's longitudinal axis, with the longitudinal direction of the containers 48, 49 running parallel to the ship's longitudinal axis.

Identical functional modules, whose functions correspond to one another, for the ship's propulsion system are accommodated within each of the two containers 48, 49. The functional modules which are accommodated in the upper container 48 in FIG. 4 are associated in a corresponding manner with the port-side steering propeller 28. Further, the functional modules which are accommodated in the lower container 49 in FIG. 4 are associated in a corresponding manner with the starboard-side steering propeller 28.

The functional modules which are contained in the starboard-side container 49 are arranged, with reference to the ship's longitudinal axis, symmetrically with respect to the functional modules which are contained in the port-side container 48 and whose function and type correspond.

In a corresponding manner, the functional modules in the container 49 associated with the starboard-side steering propeller 28 are arranged within the container 49 in mirror-image form, with reference to the longitudinal center axis of the container 49, with respect to the functional modules in the container 48, which is associated with the port-side steering propeller 28, arranged within the container 48, with reference to the longitudinal center axis of the container 48.

Since the upper container 48 and the lower container 49 correspond to one another in terms of their function and effect, only the lower container 49 will be described in detail in the following text, although all the statements and descriptions made with reference to the lower container 49 also apply to the upper container 48 in FIG. 4.

An inspection catwalk 52, which extends along the entire container 49, is provided on that longitudinal wall 51 of the lower container 49 which faces the ship's longitudinal axis. This inspection catwalk 52, associated with the container 49, is connected via a transverse catwalk 54, which is provided on those end walls 53 of the containers 48, 49 which are on the steering propeller side, to an inspection catwalk, corresponding to the inspection catwalk 52 in the container 49, in the upper container 48 in FIG. 4.

In its longitudinal wall 51 facing the ship's longitudinal axis, the container 49 has, close to this transverse catwalk 54, a door 55 through which a connection is created between the inspection catwalk 52 which extends on the outside of the longitudinal wall 51 of the container 49, and an inspection catwalk 56 which is provided within the container 49.

transformer system 57, a converter system 58, a control and regulation unit 59, a power supply section 60 and a converter cooling system 61 are arranged as functional modules of the ship's propulsion system within the container 49—and within the upper container 48 as well.

The transformer system 57 is arranged in a separate chamber 62 in the container 49, which is formed by that end wall 63 which is remote from the steering propeller and a transverse wall 65, which extends at right angles between that longitudinal wall 51 which faces the ship's longitudinal axis and that longitudinal wall 64 of the container 49 which is remote from the ship's longitudinal axis.

In the exemplary embodiment illustrated in FIG. 4, the transformer system 57 has three converter transformers 66, 67, 68, which are arranged successively within the chamber 62, in the longitudinal direction of the container 49.

Cable entries for the converter transformers 66, 67, 68 of the transformer system 57 are formed in that end wall 63 which is remote from the steering propeller, to be precise in the region of the lower corner, remote from the ship's longitudinal axis, of the end wall 63 which is remote from the steering propeller.

The converter transformers 66, 67, 68 of the transformer system 57 are cooled by way of a ventilation system 69, with the ventilation system 69 being indicated in only one specific embodiment in FIG. 5. The ventilation system 69 can, furthermore, be used in order to cool those installations provided outside the chamber 62 within the container 49 in addition, by way of part of the airflow.

In the exemplary embodiment illustrated in FIG. 5, the ventilation system 69 has an air circuit 70, in which an air cooler 71 is arranged, in the exemplary embodiment illustrated in FIG. 5. In the exemplary embodiment illustrated in FIG. 5, this is located underneath the base wall 72 of the container 49, to be precise close to that end wall 63 which is remote from the steering propeller.

Alternatively, it is possible to arrange the air cooler on the inside of that end wall 63 of the container 49 which is remote from the steering propeller, that is to say within the container 49 or within its chamber 62.

In the exemplary embodiment illustrated in FIGS. 4 and 5, each winding of each converter transformer 66, 67, 68 in each case has an associated cooling air inlet opening, through which cooling air is directed onto the respective winding from underneath. In this case, the diameter of the cooling air inlet opening corresponds approximately to the diameter of the winding associated with it, with the aim being to achieve at least the same diameter as a transformer core laminate.

Instead of using a ventilation system for cooling, a water cooling system can also be provided, which can then likewise be arranged within the chamber 62, to be precise in the vicinity of that end wall 63 which is remote from the steering propeller.

Three hatches, which are used for installation and maintenance purposes but are not illustrated in the figures, are provided in the region of the chamber 62 in that longitudinal wall 51 of the container 49 which faces the ship's longitudinal axis, with one hatch in each case being associated with one of the three converter transformers 66, 67, 68. The converter transformers 66, 67, 68 are thus accessible from the inspection catwalk 52 on the outside of that longitudinal wall 51 which faces the ship's longitudinal axis, so that specific installation work as well as maintenance and repair work can be carried out from there.

The converter system 58 is arranged on that side of the transverse wall 65 which faces away from the transformer system 57 and one of its faces is seated on the inside of that longitudinal wall of the container 49 which faces the ship's longitudinal axis. In addition to the converter system 58, one face of the control and regulation unit 59 is likewise seated on the inside of that longitudinal wall 51 of the container 49 which faces the ship's longitudinal axis.

The converter cooling system 61 is seated in the corner formed by that longitudinal wall 51 which faces the ship's longitudinal axis and that end wall 53 of the container 49 which is on the steering propeller side. An intermediate space 63 is formed between the converter cooling system 61 and the control and regulation unit 59, through which a connection is produced between the door 55 and the inspection catwalk 56 inside the container.

The power supply section 60 is arranged in the corner formed by the end wall 53 on the steering propeller side and that longitudinal wall 64 of the container 49 which is remote from the ship's longitudinal axis. A cable opening, which is not illustrated in FIGS. 4 and 5, for a connection cable between the power supply section 60 arranged in the container 49 and the electric motor of the starboard-side steering propeller 28, associated with the container 49, is arranged in that end wall 53 of the container 49 which is on the steering propeller side, to be precise in the region of its upper corner, which is remote from the ship's longitudinal axis.

The converter system 58 has a direct converter 74, 75, which is also provided for further ship-specific purposes.

The converter cooling system 61 for the converter system 58 is in the form of a water cooling system in the illustrated exemplary embodiment.

Furthermore, the converter system 58 has a connection panel 76 on the machine side. Hatches, which are not illustrated in FIGS. 4 and 5, are provided in the region of the direct converter 74, 75 in that longitudinal wall 51 of the container 49 which faces the ship's longitudinal axis and—in a comparable way into the hatches associated with the converter transformers 66, 67, 68—are used for installation, servicing, maintenance and repair purposes.

The system can be formed and provided in order to accommodate further functional modules of the ship's propulsion system, in further containers, which in terms of their handling capability and their dimensions are identical to those of the containers 49 described above. It is thus possible, for example, to provide a low-voltage switchgear assembly and an associated rotating converter for the propulsion system in one such container, in the form of a 40' standard container. A medium-voltage switchgear assembly and an associated rotating converter can also be arranged in one such container. Corresponding pick-up points and surfaces must then be provided for such containers in the ship.

The converter system 58, which is accommodated in the container 49 or in the container 48, is in the form of a 12-pulse direct converter power section in the illustrated exemplary embodiment. The input voltage for this 12-pulse direct converter power section 58 is approximately 900 V 3-phase.

In order to ensure, in the case of the containers 48, 49 illustrated in FIG. 4, that their configuration as 40' standard containers provides sufficient space to accommodate the described functional modules, the 12-pulse direct converter power section 58 does not have any connection panel on the power supply system side. In fact, the busbar system on the power supply system side for thyristor modules of 12-pulse direct converter power section 58 is designed such that power cables for the converter transformers 66, 67, 68 can be connected directly.

Furthermore, in the illustrated embodiment, current transformers and overvoltage protection units are arranged in the region behind the thyristor modules of the 12-pulse direct converter power section 58.

The insulation voltage of the power cable between the converter transformers 66, 67, 68 at one end and the converter system or the 12-pulse direct converter power section 58 at the other end is 4 kV in the illustrated embodiment.

The power cables, which are not illustrated in the figures, between the converter transformers 66, 67, 68 at one end and the converter system or the 12-pulse direct converter power section 58 at the other end, are arranged in a cable rack, which is arranged in the upper region of the container 49. In a corresponding way, these power cables are routed from the converter transformers 66, 67, 68 upward to the cable rack, and are routed downward from the cable rack to the thyristor modules of the converter system or of the 12-pulse direct converter power section 58.

If the cable rack is arranged within the container 49, a solution is possible in which the cable rack is arranged removably in the upper region of the container 49. Alternatively, the cable rack can also be arranged in the upper region of the container 49 such that the functional modules which are to be accommodated in the container 49, namely the transformer system 57, the converter system 58, the control and regulation unit 59, the power supply section 60 and the converter cooling system 61, possibly as well as further functional modules, can be installed without any interference.

In the illustrated exemplary embodiment, the two containers 48, 49 have no false cable floor.

The basic frame of the container 49 or of the container 48 has transverse supports, which are designed as foundation supports for the converter system 58, for the control and regulation unit 59, for the power supply section 60 and for the converter cooling system 61, with a transverse support for the power supply section 60 and for the converter cooling system 61 being provided in the illustrated embodiment.

The converter transformers 66, 67, 68 of the transformer system 57 have an iron foundation bar, which is lengthened such that it can be welded to the base frame or outer frame of the container 49.

The base frame of the containers 48, 49 and, possibly, of any further containers which accommodate functional modules of the ship's propulsion system, is designed and provided with suspension means, crane eyes, shackles and the like, such that each container, which accommodates function modules of the propulsion system, can be transported by way of a container crane.

The longitudinal walls 51, 64, the end walls 53, 63 and the top wall of the container 49, 48 are in the form of a unit. In a corresponding way, they can be removed from the base wall 72 of the container 48, 49 as a unit, like a cover, for installation of the functional modules in the container 48, 49, and can be fitted back onto the base wall 72 once again after installation.

With regard to the configuration of those points in the ship which hold the containers described above, it is necessary to ensure that successive pick-up points and supports are provided at said points in the longitudinal direction of the container 48, 49, such that the distance between the points is a maximum of 3 m.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A ship, comprising:

a hull, intended for accommodating at least one of cargo and people; and at least two rotatable steering propellers as a propulsion unit, wherein the rotatable steering propellers are arranged in the stern of the hull and wherein components for controlling the steering propellers are located in the hull, the steering propellers each including an electric propeller motor, and wherein the electrical and mechanical components for supplying power to and controlling each steering propeller and an associated electric motor are at least partially combined in functional modules, wherein the ship includes a ship propulsion system with at least three functional modules including a power generator system, a power distribution system and a propeller drive, and wherein components for controlling the steering propellers are arranged in the hull, the functional modules are in a form of a transport container designed as being functionally testable, the transport containers being installable at a desired location in the ship based upon a given container base structure, and the transport containers are in a form of at least one of 40' and 12 m containers.

2. The ship as claimed in claim 1, wherein the functional modules are arranged in the stern.

3. The ship as claimed in claim 1, wherein the ship includes at least one diesel generator set in a container in at least one of a front part of the ship and side sponsons.

4. The ship as claimed in claim 1, wherein said ship includes a control module for each steering propeller.

5. The ship as claimed in claim 1, wherein the ship includes two functional modules for one steering propeller, one each for a winding system of the propeller motor.

6. The ship as claimed in claim 1, wherein said ship includes functional modules with at least one of remote diagnosis and remote transmission devices, with electrical devices being provided which are mounted in or on the containers and which include position finding sensors, and devices which transmit determined position details.

7. The ship as claimed in claim 1, further comprising two steering propellers, wherein each steering propeller includes a respectively associated container, in which functional modules, associated with the steering propeller, of a propulsion system for the ship are arranged.

8. The ship as claimed in claim 7, wherein the two containers which contain the functional modules associated with the two steering propellers are arranged symmetrically with respect to one another with reference to the ship's longitudinal axis, with the starboard-side container and the port-side container containing identical functional modules and the functional modules contained in the starboard-side container being arranged, with reference to the ship's longitudinal axis, symmetrically with respect to the functional modules contained in the portside container and whose functions and types correspond to them.

9. The ship as claimed in claim 7, wherein an inspection catwalk is provided on the outside of each of the longitudinal walls, facing the ship's longitudinal axis, of each of the containers associated with the two steering propellers.

10. The ship as claimed in claim 7, wherein each of the two containers associated with the steering propellers includes a door in its longitudinal wall facing the ship's longitudinal axis, through which door access can be gained to an inspection catwalk provided in the container.

11. The ship as claimed in claim 9, wherein a transformer system, a converter system, a control and regulation unit, a power supply section and a converter cooling system are arranged in each of the two containers associated with the steering propellers.

12. The ship as claimed in claim 11, wherein the transformer system in each of the two containers includes one to three converter transformers.

13. The ship as claimed in claim 11, wherein in each container, the transformer system is arranged in a separate chamber, separated by a transverse wall, or in a separate container alongside.

14. The ship as claimed in claim 13, wherein in each container, the chamber accommodating the transformer system is arranged between the transverse wall and an end wall of the container which is remote from the steering propeller.

15. The ship as claimed in claim 11, wherein converter transformers in the transformer system in each container associated with the steering propellers can be cooled by a ventilation system.

16. The ship as claimed in claim 15, wherein the ventilation system includes an air circuit in which an air cooler is arranged.

17. The ship as claimed in claim 16, wherein the air cooler is arranged on the inside of an end wall of the container which is remote from the steering propeller.

18. The ship as claimed in claim 15, wherein air guide plates are arranged on the converter transformers and guide the cooling air flow onto salient-pole cores of windings.

19. The ship as claimed in claim 11, wherein converter transformers in the transformer system in each container associated with the steering propellers can be cooled by a water cooling system, with a water cooler for the water cooling system preferably being arranged on that end wall of the container which is remote from the steering propeller associated with it.

20. The ship as claimed in claim 11, wherein each converter transformer in the transformer system includes an associated hatch, formed in that longitudinal wall of the container which faces the ship's longitudinal axis.

21. The ship as claimed in claim 13, wherein the converter system, the control and regulation unit, an intermediate area for the inspection catwalk on the container side, and the converter cooling system are arranged successively in each of the two containers associated with the steering propellers, on the inside of that longitudinal wall of the container which faces the ship's longitudinal axis, starting from the transverse wall in the direction of that end wall of the container which is on the steering propeller side.

22. The ship as claimed in claim 11, wherein the converter cooling system for each of the containers associated with the two steering propellers is in the form of a water cooling system.

23. The ship as claimed in claim 11, wherein a direct converter in the converter system includes an associated service opening, formed in that longitudinal wall of the container which faces the ship's longitudinal axis.

24. The ship as claimed in claim 11, wherein a busbar system, on the power supply system side, for thyristor modules in a direct converter power section of the converter system is designed such that power cables for the converter transformers can be connected directly.

25. The ship as claimed in claim 11, wherein a cable rack is provided for the power cables between the converter transformers at one end and the converter systems at the other end.

26. The ship as claimed in claim 11, wherein a base frame of each container associated with the two steering propellers has transverse supports, designed as foundation supports for the converter system, for the control and regulation unit, for the power supply section and for the converter cooling system.

27. The ship as claimed in claim 7, wherein each container which accommodates the functional modules of the ship's propulsion system includes at least one of successive associated pick-up points and supports in the longitudinal direction of the container, with the distance between adjacent pick-up points or supports being a maximum of 3 m.

28. The ship as claimed in claim 2, wherein the functional modules are arranged in a vicinity of a rotatable steering propeller.

29. The ship as claimed in claim 2, wherein the ship includes at least one diesel generator set in a container in at least one of a front part of the ship and side sponsons.

30. The ship as claimed in claim 2, wherein said ship includes a control module for each steering propeller, if there are two or more steering propellers.

31. The ship as claimed in claim 3, wherein said ship includes a control module for each steering propeller, if there are two or more steering propellers.

* * * * *